US005150481A

United States Patent [19]

Pang

[11] Patent Number: 5,150,481

[45] Date of Patent: Sep. 29, 1992

[54] ANTI-LIQUID SPLASH DEVICE

[76] Inventor: Hian S. Pang, 7 Watten Drive, Singapore, Singapore, 1128

[21] Appl. No.: 675,178

[22] Filed: Mar. 26, 1991

[51] Int. Cl.[5] ..... E03D 9/00

[52] U.S. Cl. ..... 4/300.3

[58] Field of Search ..... 4/300.3, 661; 220/501, 220/531, 719

[56] References Cited

U.S. PATENT DOCUMENTS

| | | | |
|---|---|---|---|
| 2,689,353 | 9/1954 | Schuster | 4/300.3 X |
| 4,010,497 | 3/1977 | Menter et al. | 4/300.3 |
| 4,062,070 | 12/1977 | Prince | 4/300.3 |
| 4,774,730 | 10/1988 | Ho | 4/300.3 |
| 5,031,253 | 7/1991 | Brendlinger | 4/300.3 |

FOREIGN PATENT DOCUMENTS

| | | | |
|---|---|---|---|
| 35379 | 8/1913 | Sweden | 4/300.3 |
| 2077791 | 12/1981 | United Kingdom . | |

*Primary Examiner*—Henry J. Recla
*Assistant Examiner*—Robert M. Fetsuga
*Attorney, Agent, or Firm*—Fleit, Jacobson, Cohn, Price, Holman & Stern

[57] ABSTRACT

An anti-liquid splash device for a water closet comprises a plurality of flexible elongate floats (1) extending from a support (4) which is attached to a wall (5) of a vertical limb of a U-trap at the lower half or neck (8) of a water closet bowl (7). The elongate floats can be arranged to extend across substantially the entire surface of the liquid in the flow passage of the water closet so as to deflect solid or fluid matter from immediate impact with a major part of the liquid surface theeby inhibiting the splashing effect of that impact.

10 Claims, 5 Drawing Sheets

ANTI-LIQUID SPLASH DEVICE

This invention relates to anti-liquid splash devices, and in particular to devices concerned with the inhibiting, dampening or suppression of the splashing effect when solid or liquid matter impacts a liquid surface.

During such an impact the kinetic energy of the liquid or solid matter impacting the surface is released and transferred to or shared with the impacted liquid, which thereby achieves its own momentum and is displaced from the liquid surface. The problem of splashing varies with the size of the solid matter in relation to the impacted water surface area and this in turn is related to the size of the receptacle or duct in which the liquid is present. In the case of a receptacle the impact may splash water up and indeed over the sides of the receptacle if the solid or liquid matter is of sufficient mass or size and falls through sufficient distance before impacting the liquid surface.

British patent specification 2077791 discloses an anti-liquid splash device which comprises an anchored or restrained float extending across a substantial part of the surface of the liquid. The float is arranged to be impacted by any solid matter entering the receptacle so as to deflect the solid matter from immediate impact with the liquid surface. The anti-splash device described in this patent specification is a one piece generally rigid disk shaped float. This device may suffer from the disadvantage that solid material may not be easily released therefrom after impact.

It is an aim of the present invention to achieve an anti-liquid splash device which will not obstruct the general passage of solid or liquid matter after the initial impact with the liquid surface, can be adjusted to fit receptacles of different sizes, and offers release of the solid matter from the surface of the device after impact in an improved manner. It is also an aim of the invention to provide a device which eliminates or at least reduces impact noises which would occur by direct impact of the fluid or solid material with the liquid.

It is a further aim of the invention to prevent or at least reduce odours which may spread from the liquid to the surrounding air. It is yet a further aim of the present invention to provide a device which is capable of preventing the liquid or solid material from floating on the water surface and being exposed in the receptacle.

The invention is particularly, but not exclusively concerned with the suppression of splashing in sanitary ware, in particular in water closet receptacles or bowls where a water sealed trap is formed in a U-shaped waste pipe integrally formed with the base of the receptacle and communicating with a waste pipe.

The water seal or trap is essential for hygiene purposes to retain the cleanliness of the receptacle and waste pipe wall, to form an initial mass of water for carrying away in solution the waste matter deposited in the bowl and also to form a seal against noxious gases passing up the waste pipe into the bowl from the waste services into which the water closet installation is connected. The water seal acts in conjunction with the water flushing facility from the bowl rim to sweep the contents of the bowl into the waste system in solution; a fresh water seal being formed after each flush by surplus water gathering in the U-trap, after the primary force of the flushing action has triggered the original contents of the U-trap into the waste pipe connected thereto and beyond by the connected waste and sewer system.

Whilst the water seal is virtually indispensable as described, there is the unfortunate side effect of the splashing upon the impact of solid or liquid matter, for example faeces or urine or other matter falling or deposited into the bowl.

The splashing effect will vary with the character of the impact as described generally above and may have the unpleasant and unhygienic effect of contacting the user with soiled water.

According to the present invention there is provided an anti-liquid splash device comprising a plurality of elongate floats extending from a support, the support including attachment means for attachment to a wall defining a receptacle or flow passage, wherein the elongate floats can be arranged to extend substantially parallel across substantially the entire surface of a liquid in the receptacle or fluid passage in a direction generally transversely to the liquid flow path along the passage or from the receptacle, and wherein the elongate floats can be arranged to be impacted by any solid or fluid matter entering the receptacle or moving along the flow passage to deflect such solid or fluid matter from immediate impact with a major part of the liquid surface thereby inhibiting the splashing effect of that impact.

By virtue of the fact that embodiments of the invention include floats which are free at one end, the device does not obstruct the flow of liquid and solid material when installed in a water closet.

In a preferred embodiment of the present invention, the elongate floats are each separated from adjacent ones by about 1 to 5 mm.

Each elongate float may be hingedly attached to the support so that they can be deflected downwardly into the liquid when impacted by the solid or fluid matter.

Alternatively or in addition to the hinge attachment, the elongate floats may be formed of a material sufficiently flexible that they can deflect downwardly under the weight of the impacting liquid or solid matter. This deflection serves to alleviate or eliminate the noise of impact which would otherwise occur between the solid or fluid material and the liquid surface.

Bias means may be provided between the elongate floats and the support for aiding restoration of the deflected elongate floats to their non-deflected state.

The elongate floats are preferably provided with smooth surfaces for assisting removal of the liquid and solid matter therefrom.

The elongate floats may themselves be of tubular form, or alternatively they may have a "D" cross-section to provide a flat top and round bottom.

The attachment means may comprises a surface which can be glued to the wall thereby establishing a rigid connection to the wall. Alternatively, the attachment means may comprise a hook formed on the support for engagement with a corresponding engagement member fixed to the wall of the receptacle or flow passage.

The elongate floats and support may be moulded integrally as a single piece from a plastics material, e.g. polypropylene.

The invention will now be further described by way of example, with reference to the accompanying drawings, in which;

FIG. 1*a* is a plan view of a water closet in which an embodiment of the present invention is in place;

FIG. 1*b* is a side view of the water closet of FIG. 1*a;*

FIG. 2*a* is a perspective view of a device embodying the present invention;

FIG. 2*b* is an alternative embodiment of the device embodying the present invention;

Figure 1A:
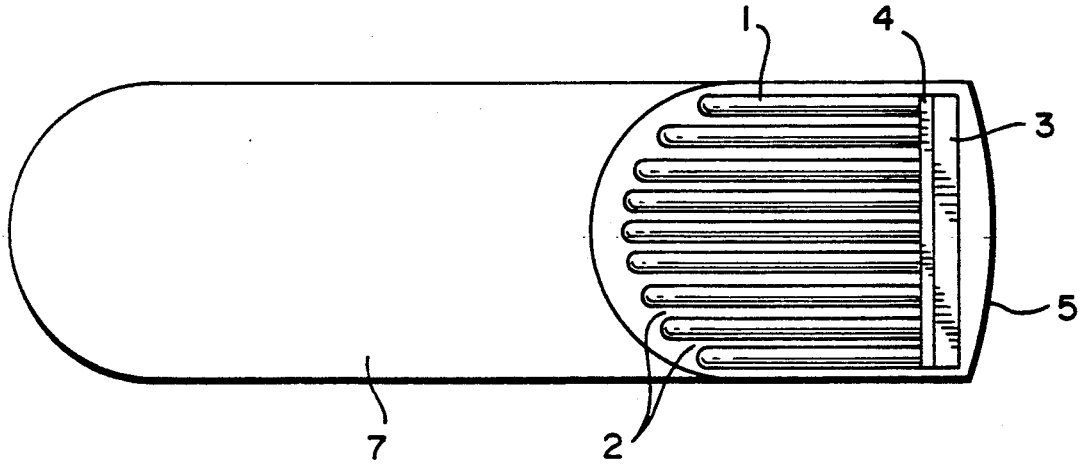
Figure 1B:
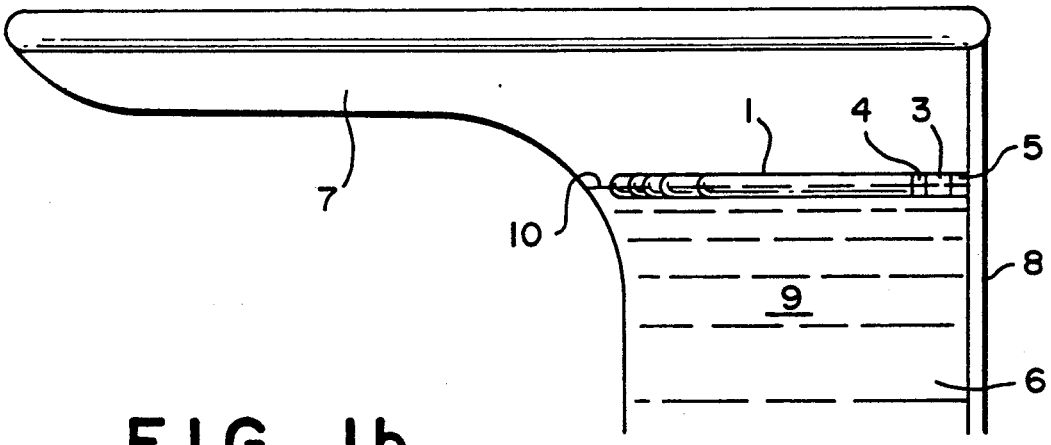

The anti-liquid splash device will be described with reference to such a device being installed in a sanitary water closet, the general arrangement being illustrated in FIGS. 1*a* and 1*b*.

The device illustrated in the figures comprises eight or nine tubular floats 1 separated from one another by a space 2 of between 1 and 5 mm. Each of the elongate floats 1 is hingedly attached to a support 3 via a hinge 4. The elongate floats 1 and the support 3 may be integrally moulded as a single piece from a plastics material, for example polypropylene. In this case, the hinge 4 can be formed from a narrow strip of the plastics material which can provide for hinged movement between the elongate floats 1 and the support 3 without breaking. A plastics hinge 4 formed in this way can maintain its integrity over a long period of time.

The support 4 can be attached to a wall 5 of the water closet by glueing or by any suitable form of attachment arrangement. It is conceivable that a hook (not shown) may be formed on the attachment means for engagement with a corresponding engagement member of the wall 5 of the water closet.

The device is attached to the wall 5 of the water closet within a water flow passage 6 comprising a vertical limb of a U-trap at the lower half or neck 8 of a water closet bowl 7. A water column 9 with an upper exposed surface 10 is located within the U-trap to form a water seal and holds waste matter which has flowed into the bowl 7 prior to discharge through the U-trap into the interconnected waste or sewerage system (not shown) by a conventional flushing mechanism.

The elongate floats 1 are dimensioned so that they extend across substantially the entire surface of the upper exposed surface 10 of the column of water 9. Ideally, there are no spaces exposed on the upper exposed surface 10 other than the spaces provided between the elongate floats 1.

Figure 2A:
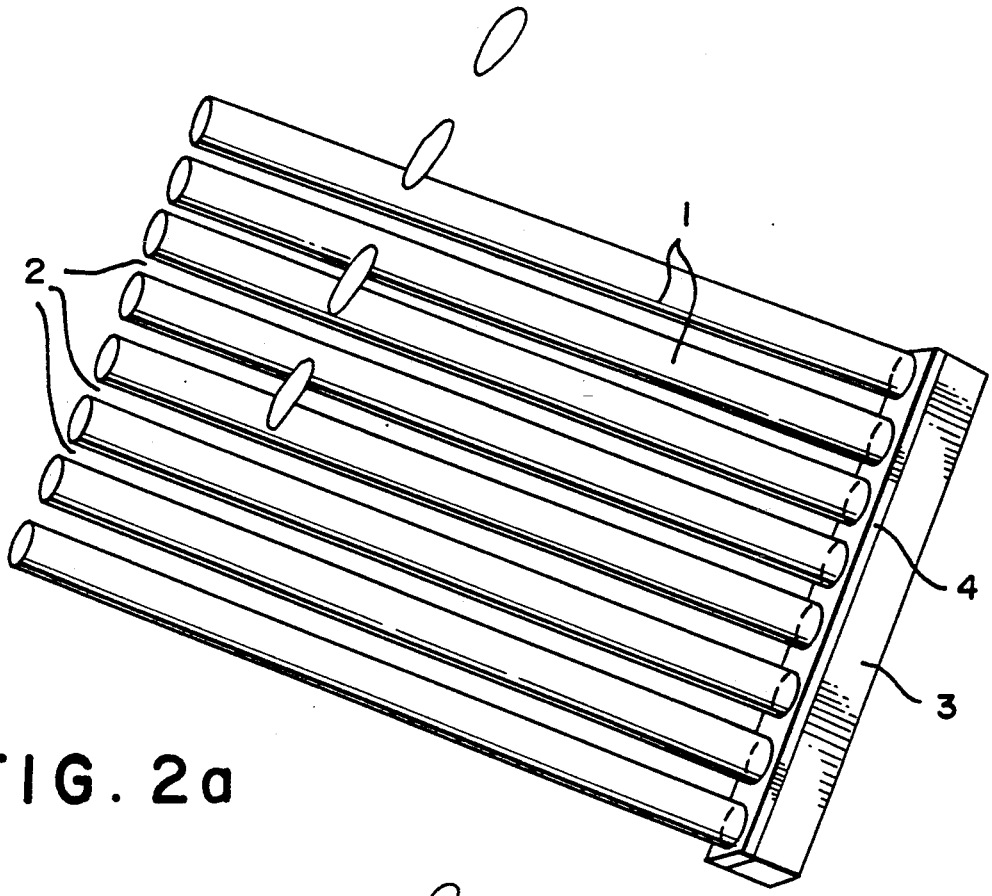
Figure 2B:
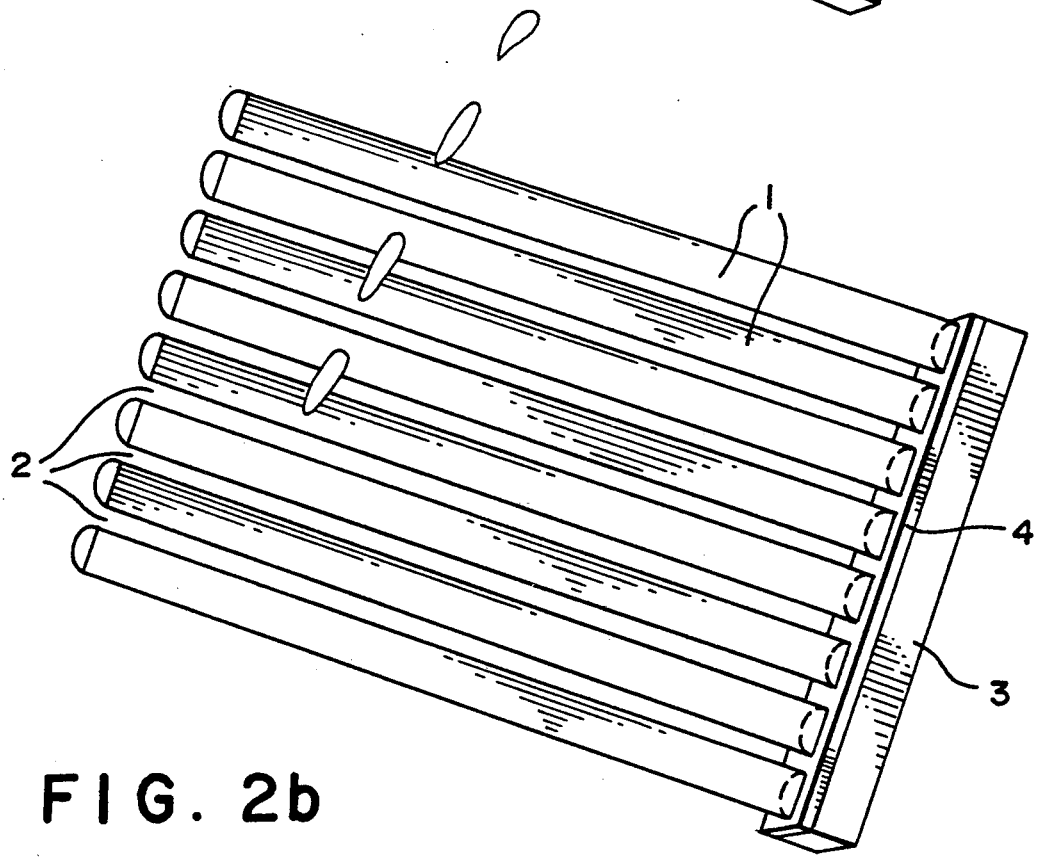

Fluid or solid matter dropped into the bowl 7 will drop onto the elongate floats 1 as illustrated in FIGS. 2*a* and 2*b*.

In FIG. 2*a*, the elongate floats are formed in tubular form from a material which inherently floats on water. FIG. 2*b* illustrates an alternative configuration of elongate floats which have a "D" cross-section whereby a flat top is exposed to the impacting solid or liquid material while the under side of the elongate floats 1 have a rounded bottom shape in order to ensure minimal water resistance as the elongate floats are caused to deflect downwardly into the liquid 9. The flat surface of the floats 1 provides for a better and larger landing surface for the liquid and solid matter.

Figure 3:
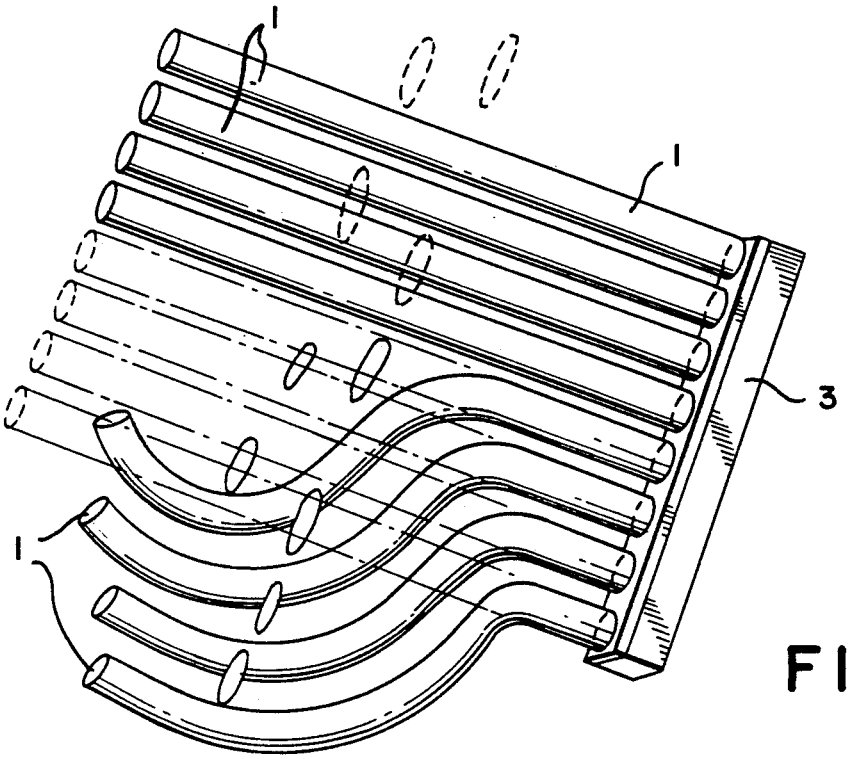
FIG. 3 is a perspective view of the embodiment of FIG. 2*a* undergoing deflection upon impact with solid or liquid material.

The elongate floats 1 are sufficiently flexible that the elongate floats 1 can deflect as illustrated in FIG. 3. The impact is absorbed by the elongate floats without causing water to splash out of the water closet. Since the elongate floats are made from a light and soft material (such as polyethylene, natural rubber, silicon rubber, polyurethane etc) the impact will be relatively quiet.

Figure 4:
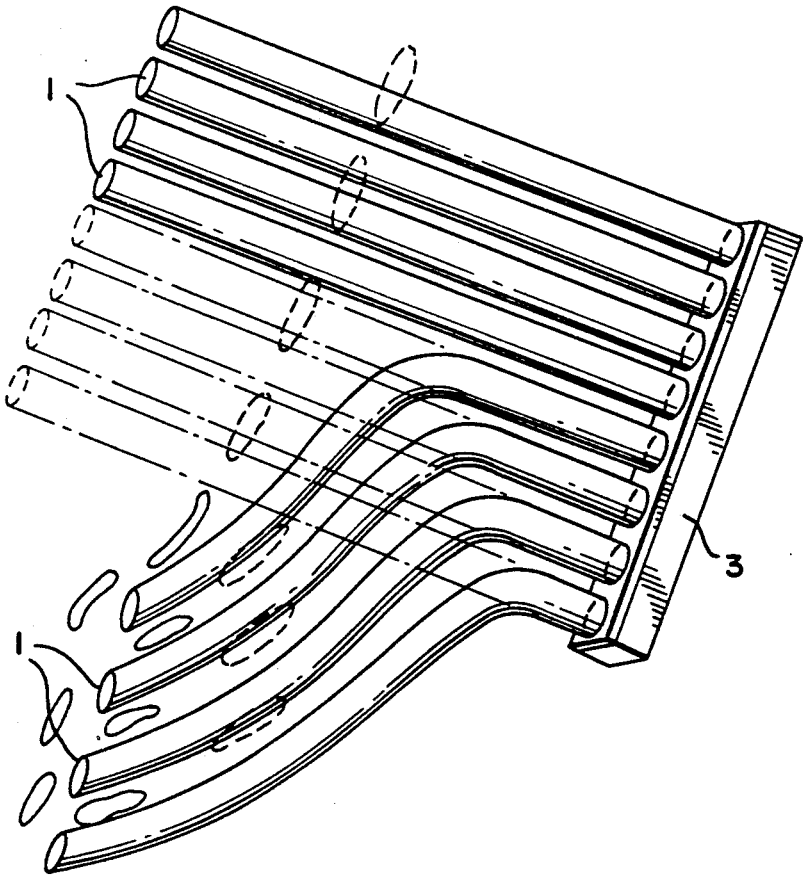
FIG. 4 illustrates the embodiment of FIG. 2*a* in which the solid or liquid material is sliding off the surface of the elongate floats.
Figure 5:
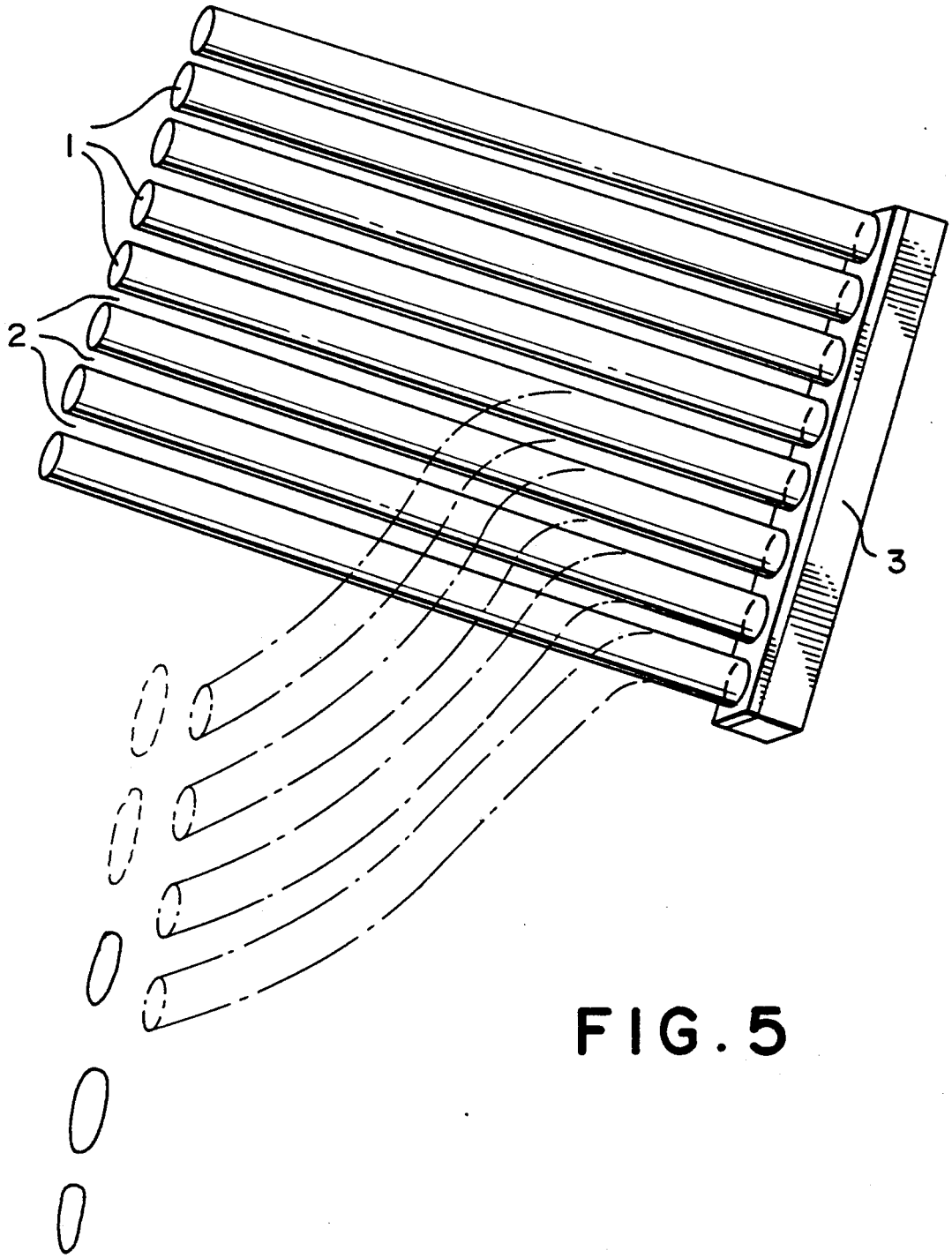
FIG. 5 illustrates the embodiment of FIG. 4 after restoration of the deflected elongate floats to their non-deflected state.

After the weight of the liquid or solid material has caused the elongate floats 1 to deflect as illustrated in FIG. 3, the material will tend to slip away from the surface of the floats 1 and down into the water 9. To assist the slipping of the material from the floats 1, the surface of the floats are such as to be very slippery. A slippery surface could be achieved by a thick coating of polyethylene, PVC or a similar type of film on the surfaces. Afterwards, the floats will tend to return to their original position as illustrated in FIGS. 4 and 5.

Flushing of the water closet will assist the removal of material from the surface of the floats 1.

Figure 6:
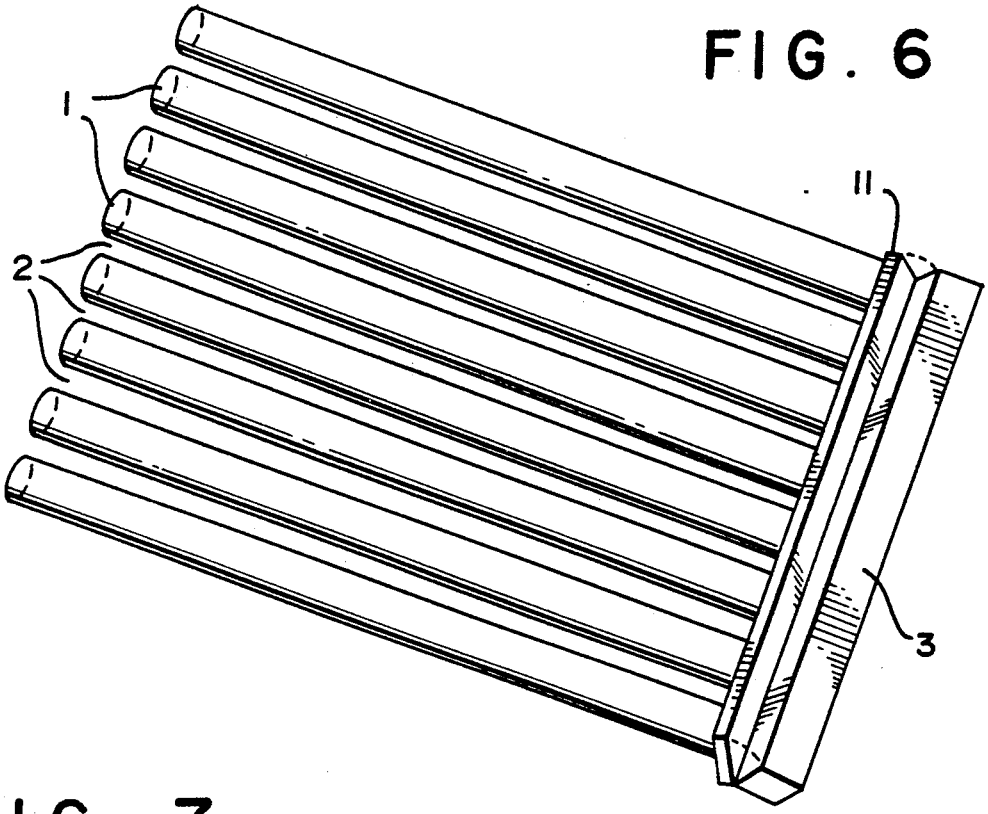
FIG. 6 illustrates an embodiment of the present invention in which bias means is provided between the elongate floats and the support.

FIG. 6 illustrates a bias means provided between a bracket 11 on which the elongate floats 1 are mounted and the support 3. The bias means, which may be in the form of an elastic or rubber material, aids return of the floats to the original non-deflected position.

Figure 7:
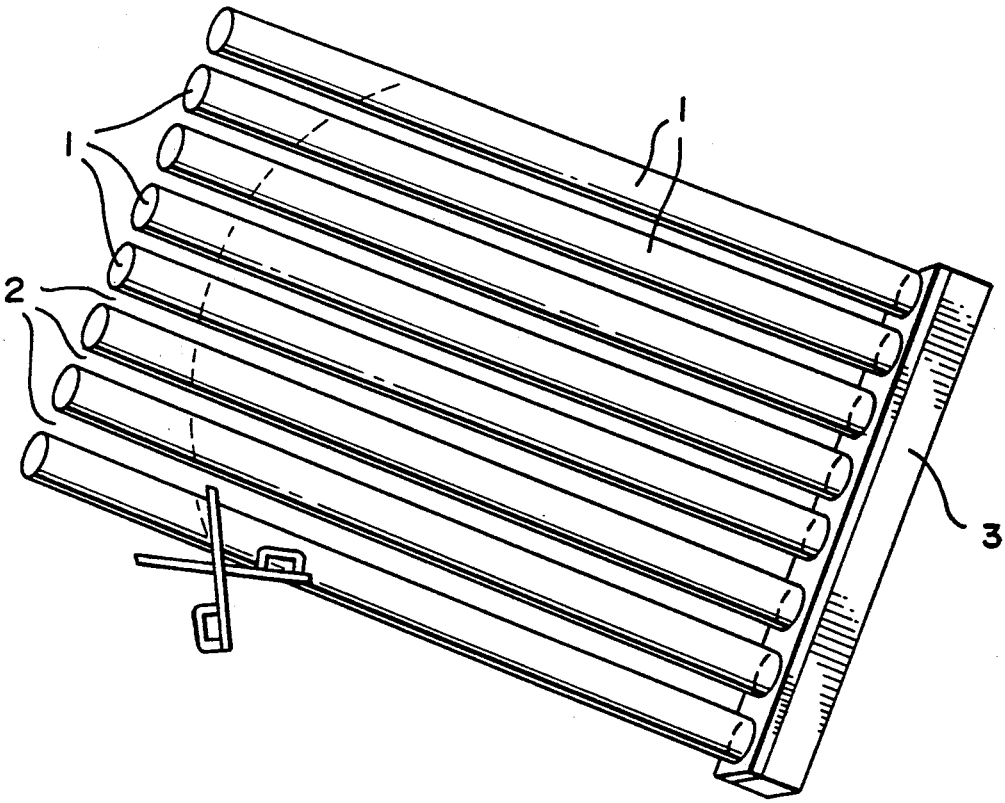
FIG. 7 illustrates how the embodiment of FIG. 2*a* can be adapted for a particular size of water closet.

As illustrated in FIG. 7, embodiments of the invention may be provided initially with relatively long elongate floats 1 so that they can be cut to fit the water closet to which the device is to be installed.

Embodiments of the invention may be constructed so that the elongate floats 1 can be detached from the support when required, thereby enabling replacement of the floats.

I claim:

1. An anti-liquid splash device for a receptacle having an upright wall, a top and containing a body of liquid therein, said device comprising a plurality of distinct elongate floats (1) secured to and extending substantially parallel to one another from a support (3), the support including attachment means for attachment to the wall (5) of the receptacle or flow passage, wherein the elongate floats can be arranged to extend across substantially the entire surface (10) of the liquid in the receptacle or flow passage in a direction generally transverse to the wall of the receptacle, and wherein the elongate floats (1) can then be arranged to be impacted by any solid or fluid matter entering the top of the receptacle to deflect such solid or fluid matter from immediate impact with a major part of the liquid surface thereby inhibiting the splashing effect of that impact.

2. An anti-liquid splash device according to claim 1, wherein each of the elongate floats (1) are separated from an adjacent one by between 1 and 5 mm.

3. An anti-liquid splash device according to claim 1 or claim 2, wherein the elongate floats and the support are integrally moulded as a single piece from a plastics material such as polypropylene.

4. An anti-liquid splash device according to claim 1, wherein each elongate float is hingedly attached to the support so that they can be deflected downwardly into the liquid when impacted by the solid or fluid matter.

5. An anti-liquid splash device according to claim 1, wherein each elongate float is formed from a material which is sufficiently flexible to enable the float to be deflected downwardly under the weight of the fluid or solid matter.

6. An anti-liquid splash device according to claim 4, wherein bias means is provided for aiding restoration of the deflected elongate floats to their non deflected state.

7. An anti-liquid splash device according to claim 1, wherein each of the elongate floats is provided with a smooth surface for aiding removal of the liquid and solid material therefrom.

8. An anti-liquid splash device according to claim 1, wherein the elongate floats are tubular in form.

9. An anti-liquid splash device according to claim 1, wherein the elongate floats have a "D" cross-section, whereby a flat top can be exposed to the impacting solid or fluid matter.

10. An anti-liquid splash device according to claim 1, wherein the elongate floats are detachable from the support.

* * * * *